US006244664B1

(12) United States Patent
Ebner et al.

(10) Patent No.: US 6,244,664 B1
(45) Date of Patent: Jun. 12, 2001

(54) EXTENDABLE END ASSEMBLY FOR A MINE FACE CUTTING ROLLER

(75) Inventors: Bernhard Ebner; Peter Kogler, both of Knittelfeld (AT)

(73) Assignee: Tamrock Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 09/355,614

(22) PCT Filed: Jan. 28, 1998

(86) PCT No.: PCT/AT98/00017

§ 371 Date: Jul. 30, 1999

§ 102(e) Date: Jul. 30, 1999

(87) PCT Pub. No.: WO98/34010

PCT Pub. Date: Aug. 6, 1998

(30) Foreign Application Priority Data

Jan. 30, 1997 (AU) ..... 145/97

(51) Int. Cl.[7] ..... E21C 25/10
(52) U.S. Cl. ..... 299/80.1; 299/71
(58) Field of Search ..... 299/80.1, 79.1, 299/71, 73

(56) References Cited

U.S. PATENT DOCUMENTS

| | | | | |
|---|---|---|---|---|
| 334,642 | * | 1/1886 | Clerc | 299/80.1 |
| 2,745,650 | * | 5/1956 | Smith | 299/80.1 |
| 3,285,667 | * | 11/1966 | Gonski | 299/80.1 |
| 3,730,593 | | 5/1973 | Karlovsky et al. | 299/80.1 |
| 4,172,616 | | 10/1979 | Delli-Gatti, Jr. | 299/80.1 |
| 4,177,866 | | 12/1979 | Mitchell | 299/80.1 |
| 4,875,738 | * | 10/1989 | Zitz et al. | 299/80.1 |

FOREIGN PATENT DOCUMENTS

| | | |
|---|---|---|
| 388 776 | 8/1989 | (AT) . |
| 991569 | 5/1965 | (GB) . |

* cited by examiner

*Primary Examiner*—William Neuder
*Assistant Examiner*—John Kreck
(74) *Attorney, Agent, or Firm*—Pillsbury Winthrop LLP

(57) ABSTRACT

In a hewing or cutting roller (1) of variable cutting width, in which two pivotable tool carriers (4, 5) for receiving cutting or hewing tools are arranged on at least one lateral end face (2) of the roller transverse to the axis of the hewing or cutting roller (1), one of the tool carriers carries a locking pin (10) which cooperates with a hook-shaped locking member of the other tool carrier in the extended position of the tool carriers (4, 5).

8 Claims, 2 Drawing Sheets

EXTENDABLE END ASSEMBLY FOR A MINE FACE CUTTING ROLLER

This, application is the national phase of international application PCT/AT98/00017 filed Jan. 28, 1998 which designated the U.S.

BACKGROUND OF THE INVENTION

1. Field of the Invention

The invention relates to a hewing or cutting roller of variable cutting width, in which two pivotable tool carriers for receiving cutting or hewing tools are arranged on at least one lateral end face of the roller transverse to the axis of the hewing or cutting roller.

2. Prior Art

AT 388 776 B has already shown a hewing or cutting roll, in which, for widening the cutting width, a tool carrier for receiving cutting or hewing tools, which is pivotable relative to the axis of the hewing or cutting roller, is arranged on at least one lateral end face of the roller. Such a known configuration has already been further developed to the extent that two tool carriers are each outwardly hinged to at least one side of the cutting roller. When extending such cutting roller widening means, all of the cutting forces and, in particular, the forces caused by the penetration into the rock must be taken over by the control cylinders. In the extended position, the cutting forces are acting in a manner that the hydraulic actuation cylinders will be outwardly stressed under tension, since the cutting forces become active outwardly in the sense of a pivotal movement of the pivotable tool carriers. In order to safely absorb such forces, double-acting hydraulic cylinder piston units and, in particular, very large dimensioned hydraulic cylinder piston units would have to be employed in the known structures.

SUMMARY OF THE INVENTION

The invention aims at providing a cutting roller widening means of the initially mentioned kind, with which small-structure hydraulic actutating drives will do and in which, furthermore, the stability of the selected position is substantially enhanced in the extended position. In the slanted position, or by pivoting, of the tool carrier, the cutting or hewing tools arranged on the tool carrier will assume adjacent positions, viewed in the axial direction, whereby parallel traces of cutting or hewing tools will be cut or broken in the mine face. The observance of a given pivoted position in that case is to ensure that the portion of cut or broken material will not change due to a displacement of the pivotable tool carriers in the extended position, whereby the wear of the pick is to be reduced at the same time. To solve this object, the configuration according to the invention essentially consists in that one of the tool carriers carries a locking pin which cooperates with a hook-shaped locking member of the other tool carrier in the extended position of the tool carriers. By means of such a locking pin cooperating with a hook-shaped locking member of the other tool carrier, a precisely defined extended position in which the tool carriers can be safely locked without provoking an excessive load on the actuation means for pivoting the tool carriers or a change in the pivoted position during operation may be ensured. As a result, the actuation cylinders are relieved and a rigid assembly is formed, with which the cutting traces are precisely followed even in the extended position of the tool carriers.

In a particularly advantageous manner, the configuration is devised such that the locking pin extends substantially parallel to the pivot axis of the tool carrier and that the hook-shaped locking member is constituted by a slot formed in the other tool carrier facing the locking pin. By means of such a configuration, a particularly high stability is achieved and, at the same time, the space required for the pivoting of the tool carriers is kept clear. Advantageously, the slot opening is arranged so as to be inclined in the direction towards the pivot axis of the tool carrier, whereby it is safeguarded that, in the pivoted-out position, the forces acting in the sense of widening are taken up by an accordingly steep flank of the slot, against which the locking pin is supported.

In order to ensure safe pivoting and a high degree of stability, the configuration advantageously is devised such that the tool carriers are connected to common pivoting by a coupling rod. In such a configuration, pivoting may be effected by means of but one hydraulic cylinder piston unit while simultaneously pivoting into the desired position both of the pivotable tool carriers. Advantageously, the configuration is devised such that the tool carriers are each connected with a hydraulic cylinder piston unit coupled to the hewing or cutting roller and outside the pivot axes of the tool carriers, wherein particularly small-structure hydraulic cylinder piston units will do as actuating cylinders.

BRIEF DESCRIPTION OF THE DRAWINGS

In the following, the invention will be explained in more detail by way of en exemplary embodiment schematically illustrated in the drawing.

Therein, FIG. 2 is a partially sectioned top view on the end wall of the roller with the tool carriers being pivoted in.

DETAILED DESCRIPTION OF PREFERRED EMBODIMENTS OF THE INVENTION

Figure 1:
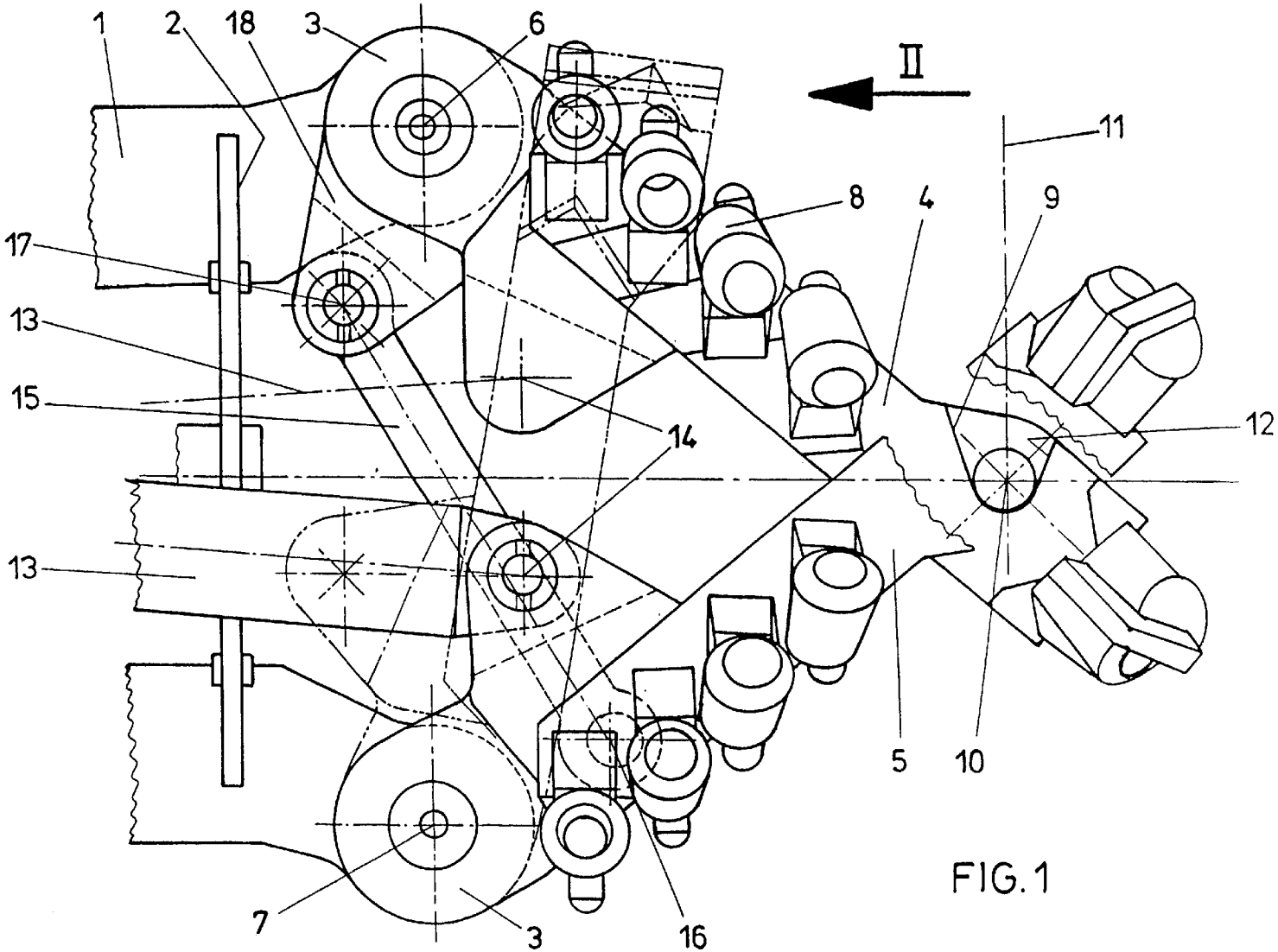
FIG. 1 is a view on an end face region of a hewing roller, seen in the direction transverse to the axis of rotation of the roller with the tool carriers being in the tilted-out position.

FIG. 1 depicts a hewing roller 1 to whose end sides 2 bearing eyes 3 for the pivotable articulation of tool carriers 4 and 5 are fixed. The tool carriers 4 and 5 are pivotable about pivot axes 6 and 7 and each carry a pick denoted by 8. One of the two pivotable tool carriers (carrier 4) is provided with a slot 9, which constitutes a hook-shaped locking member for a locking pin 10, the axis 11 of the slot opening of the slot 9 being arranged in a manner inclined relative to the tool carrier 4. In the extended position, the locking pin 10, thus, is supported on a steep flank 12 of the slot 9, thereby enabling the reaction forces acting in the sense of widening to be safely supported.

Pivoting of the tool carriers 4 and 5 about the pivot axes 6 and 7 is effected by means of hydraulic cylinder piston units 13 engaging at a bearing eye 14 of the respective tool carrier 5 and 4, respectively. The upper one of the two hydraulic cylinder piston units 13, for the sake of simplicity, is merely indicated by a dot-and-dash line.

In order to further enhance the stability during pivoting, a coupling rod 15 is provided, which engages at the tool carrier 5 in a manner pivotable about a pivot axis 16. The other end of the coupling rod is hinged to a bearing eye 18 of the tool carrier 4 so as to be pivotable about the pivot axis 17. The oscillation kinetics forced by a connecting or coupling rod of this type enables both tool carriers 4 and 5 to be pivoted merely by a single hydraulic cylinder piston unit 13. However, preferably, both of the tool carriers 4 and 5 are pivoted into their extended positions by means of hydraulic cylinder piston units 13.

Figure 2:
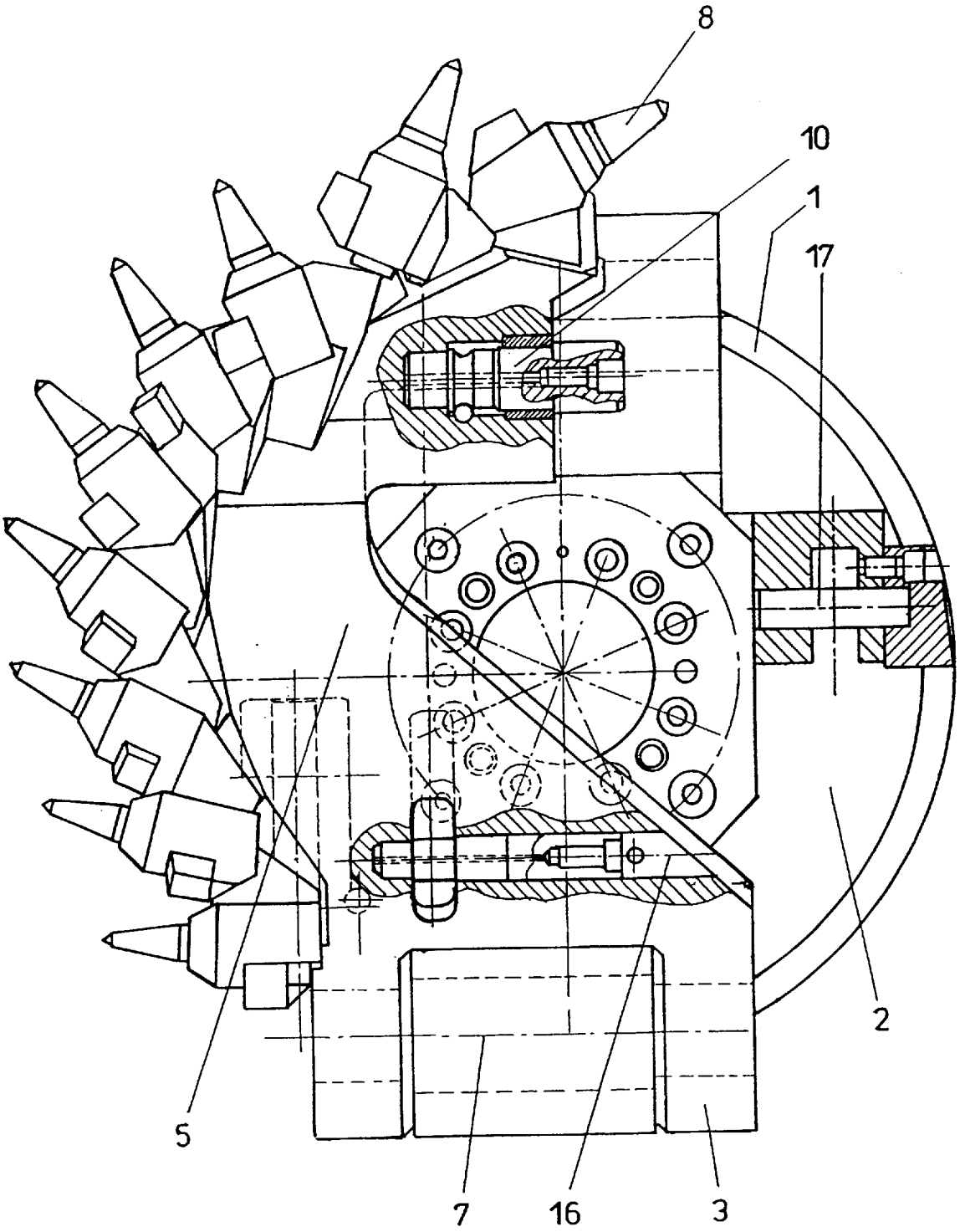

In the illustration according to FIG. 2, the tool carrier 5 is represented in the pivoted-in position and the tool carrier 4 not at all. As for the rest, the reference numerals of FIG. 1 have been identically retained. FIG. 2, thus, is a view on the end wall 2 of the hewing roller 1 in the sense of the arrow II of FIG. 1, wherein, however, the tool carriers 4 and 5 have been pivoted into their starting positions, thus causing the locking pin 10 to be disengaged and pivoted towards the edge of the hewing roller.

What is claimed is:

1. A hewing or cutting roller (1) of variable cutting width, in which two pivotable tool carriers (4, 5) for receiving cutting or hewing tools are arranged on at least one lateral end face (2) of the roller, wherein the tool carriers are angularly disposed relative to a longitudinal axis of the roller (1), and wherein one of the tool carriers carries a locking pin (10) which cooperates with a hook-shaped locking member of the other tool carrier in an extended position of the tool carriers (4, 5).

2. A hewing or cutting roller according to claim 1, wherein the locking pin (10) extends substantially parallel to respective pivot axes (7) of the tool carriers and that the hook-shaped locking member comprises a slot (9) facing the locking pin (10).

3. A hewing or cutting roller according to claim 2, wherein the slot has an opening arranged so as to be inclined in a direction towards the pivot axis of its respective tool carrier.

4. A hewing or cutting roller according to any one of claims 1, 2 or 3, wherein the tool carriers (4, 5) are connected for common pivoting by a coupling rod (15).

5. A hewing or cutting head according to claim 3, wherein the tool carriers (4, 5) are respectively connected with at least one hydraulic cylinder piston unit (13) which is coupled to the hewing or cutting roller (1) at a position spaced from the pivot axes (6, 7) of the tool carriers (4, 5).

6. A hewing or cutting head according to claim 3, wherein the tool carriers (4, 5) are each connected with a respective hydraulic cylinder piston unit (13) coupled to the hewing or cutting roller (1) at a position spaced from pivot axes (6, 7) of the tool carriers (4, 5) and wherein the tool carriers (4, 5) are connected for common pivoting by a coupling rod (15).

7. A hewing or cutting head according to claim 2, wherein the tool carriers (4, 5) are respectively connected with at least one hydraulic cylinder piston unit (13) which is coupled to the hewing or cutting roller (1) at a position spaced from the pivot axes (6, 7) of the tool carriers (4, 5).

8. A hewing or cutting roller according to claim 1, wherein the tool carriers (4, 5) are respectively connected with at least one hydraulic cylinder piston unit (13) which is coupled to the hewing or cutting roller (1) at a position spaced from pivot axes (6, 7) of the tool carriers (4, 5).

* * * * *